US008381703B2

(12) United States Patent
Hund et al.

(10) Patent No.: US 8,381,703 B2
(45) Date of Patent: Feb. 26, 2013

(54) METHOD FOR CALIBRATING AN ACCELERATOR PEDAL

(75) Inventors: Christoph Hund, Tettnang (DE); Rudolf Fensterle, Ertingen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 944 days.

(21) Appl. No.: 12/421,109

(22) Filed: Apr. 9, 2009

(65) Prior Publication Data

US 2009/0288637 A1 Nov. 26, 2009

(30) Foreign Application Priority Data

Apr. 9, 2008 (DE) ..... 10 2008 017 855

(51) Int. Cl.
*F02D 11/10* (2006.01)
*F02D 41/00* (2006.01)

(52) U.S. Cl. ..... 123/399; 123/339.14

(58) Field of Classification Search ..... 123/339.14, 123/399

See application file for complete search history.

(56) References Cited

U.S. PATENT DOCUMENTS 5,150,681 A * 9/1992 Kull et al. ..... 123/399
5,445,126 A * 8/1995 Graves, Jr. ..... 123/399
5,476,078 A * 12/1995 Pfalzgraf et al. ..... 123/399
5,501,193 A * 3/1996 Schneider et al. ..... 123/339.14
5,602,732 A * 2/1997 Nichols et al. ..... 702/185
5,960,771 A * 10/1999 Watanabe ..... 123/396
6,295,501 B1 * 9/2001 Funcke et al. ..... 701/110
7,340,337 B2 * 3/2008 Katrak ..... 701/70

FOREIGN PATENT DOCUMENTS

DE 36 12 904 10/1987
DE 196 28 162 1/1998

* cited by examiner

*Primary Examiner* — Stephen K Cronin
*Assistant Examiner* — David Hamaoui
(74) *Attorney, Agent, or Firm* — Lucas & Mercanti, LLP; Klaus P. Stoffel

(57) ABSTRACT

A method for calibrating an accelerator pedal during a driving operation, in which the mechanical position of the accelerator pedal is converted by at least one potentiometer to an electrical signal value and read in by an electronic engine control unit. An idle limit for an idle position of the accelerator pedal and a full-load limit for a full-load position of the accelerator pedal are set as initial values. An idle signal value that is less than or equal to the idle limit is stored in a potentiometer-specific idle data memory for each potentiometer, a representative idle signal value is determined from the stored idle signal values, and this value is set as the determining idle position of the accelerator pedal specific to each potentiometer. A full-load signal value that is greater than or equal to the full-load limit is stored in a potentiometer-specific full-load data memory for each potentiometer, a representative full-load signal value is determined from the stored full-load signal values, and this value is set as the determining full-load position of the accelerator pedal specific to each potentiometer.

6 Claims, 7 Drawing Sheets

METHOD FOR CALIBRATING AN ACCELERATOR PEDAL

BACKGROUND OF THE INVENTION

The present invention concerns a method for calibrating an accelerator pedal during driving operation, in which the mechanical position of the accelerator pedal is converted by at least one potentiometer to an electrical signal value and read in by an electronic engine control unit.

The operating point of an internal combustion engine can be preset by an accelerator pedal. The mechanical position of the accelerator pedal is converted by at least one potentiometer (three potentiometers are usually used) to an electrical signal and read in by an electronic engine control unit. Temperature effects and mechanical misalignment cause a change in the association of the mechanical position of the accelerator pedal to the electrical signal value of the connected potentiometer. Moreover, when several potentiometers are used on an accelerator pedal, the signal values are not identical, for example, in the idle position.

DE 36 12 904 A1 describes a method for calibrating an accelerator pedal during driving operation by means of an adaptive learning program. In a first step, the current signal values of the potentiometers are compared with an idle limit and a full-load limit to determine permissibility. If the signal values are permissible, then, in a second step, the current signal value is compared with the preceding signal value. If, for example, the current idle signal value is less than the preceding idle signal value for this potentiometer, then the current idle signal value is set as the determining value for the idle position of the accelerator pedal. The idle signal value is thus adapted towards smaller values. Similarly, the full-load signal value is adapted towards larger values, and the learned value is set as the determining value for the full-load position of the accelerator pedal. To protect against error, a timing element is provided, by which the signal values are set back to the given idle or full-load limit if, for example, the current idle signal value is at a higher value than the learned idle signal value. In practice, the on-board supply voltage is often superposed by interference voltage pulses (spike, load dump), which, with the described calibration method, which can simulate, for example, a learned idle signal value that is too small. This means that despite an unactuated accelerator pedal, the electronic engine control unit electrically detects an actuated accelerator pedal. An analogous situation applies to the learned full-load signal value. The critical point is thus that the idle and full-load position are temporarily no longer detected by the electronic engine control unit during driving operation, and the signal values in between are interpreted falsely.

To solve the problem of the falsely learned idle signal value, DE 196 28 162 A1 provides that the idle position of the potentiometers of the accelerator pedal is calibrated during a visit to a repair shop or at the end of the vehicle production assembly line. In this calibration, the current idle signal value is checked for permissibility and compared with an initial signal value. If the two signal values differ only slightly, then the initial signal value plus an offset is set as the idle signal value. If a signal drift is detected, then the idle signal value is set to an alternative value. During driving operation, this idle signal value is adapted in the direction of smaller values according to the procedure described in DE 36 12 904 A1. An alternative value is also used here when signal drift is detected. Measures for the full-load position are not provided by this source.

SUMMARY OF THE INVENTION

The object of the present invention is to provide an accelerator pedal calibration method during driving operation, which is robust and in which both the idle position and the full-load position are learned.

In this calibration, as is already known from the prior art, an idle limit for an idle position of the accelerator pedal and a full-load limit for a full-load position of the accelerator pedal are set as initial values. An idle signal value that is less than or equal to the idle limit is then stored in a potentiometer-specific idle data memory for each potentiometer. A representative idle signal value is then determined from the stored idle signal values by means of a maximum value selector, and this value is set as the determining idle position of the accelerator pedal specific to each potentiometer. To supplement this procedure, a full-load signal value that is greater than or equal to the full-load limit is stored in a potentiometer-specific fill-load data memory for each potentiometer. A representative full-load signal value is then determined from the stored full-load signal values by means of a minimum value selector, and this value is set as the determining full-load position of the accelerator pedal specific to each potentiometer.

The data memory produces the advantage that only safe idle and full-load signal values are used for determining the idle position and the full-load position. The depth of memory in turn defines the operating reliability of the system, since only repeatedly confirmed signal values are used to form the representative signal value.

When several potentiometers are used, one embodiment of the invention provides for the determination of a reference potentiometer. The potentiometer that is set as the reference potentiometer is the one whose representative idle signal value is minimal. An offset of the representative idle signal value of the other potentiometer to the representative idle signal value of the reference potentiometer is then computed. After the offset has been computed, the representative full-load signal value for the reference potentiometer is set to the full-load limit. The representative full-load signal value of the other potentiometer is computed by adding the offset to the full-load limit and setting this value as the determining full-load position of the accelerator pedal. The method can be started if a representative idle signal value of the connected potentiometer is less than the idle limit. An advantage of this embodiment is that the full-load signal value is safely reached, since an estimated value is present before the full-load position is reached.

A further improvement of the operating reliability consists in limiting the representative full-load signal value and, additionally, in reducing the representative idle signal value and the representative full-load signal value by a predeterminable safety offset.

Other features and advantages of the present invention will become apparent from the following description of the invention in connection with the drawings.

DETAILED DESCRIPTION OF THE INVENTION

Figure 1:
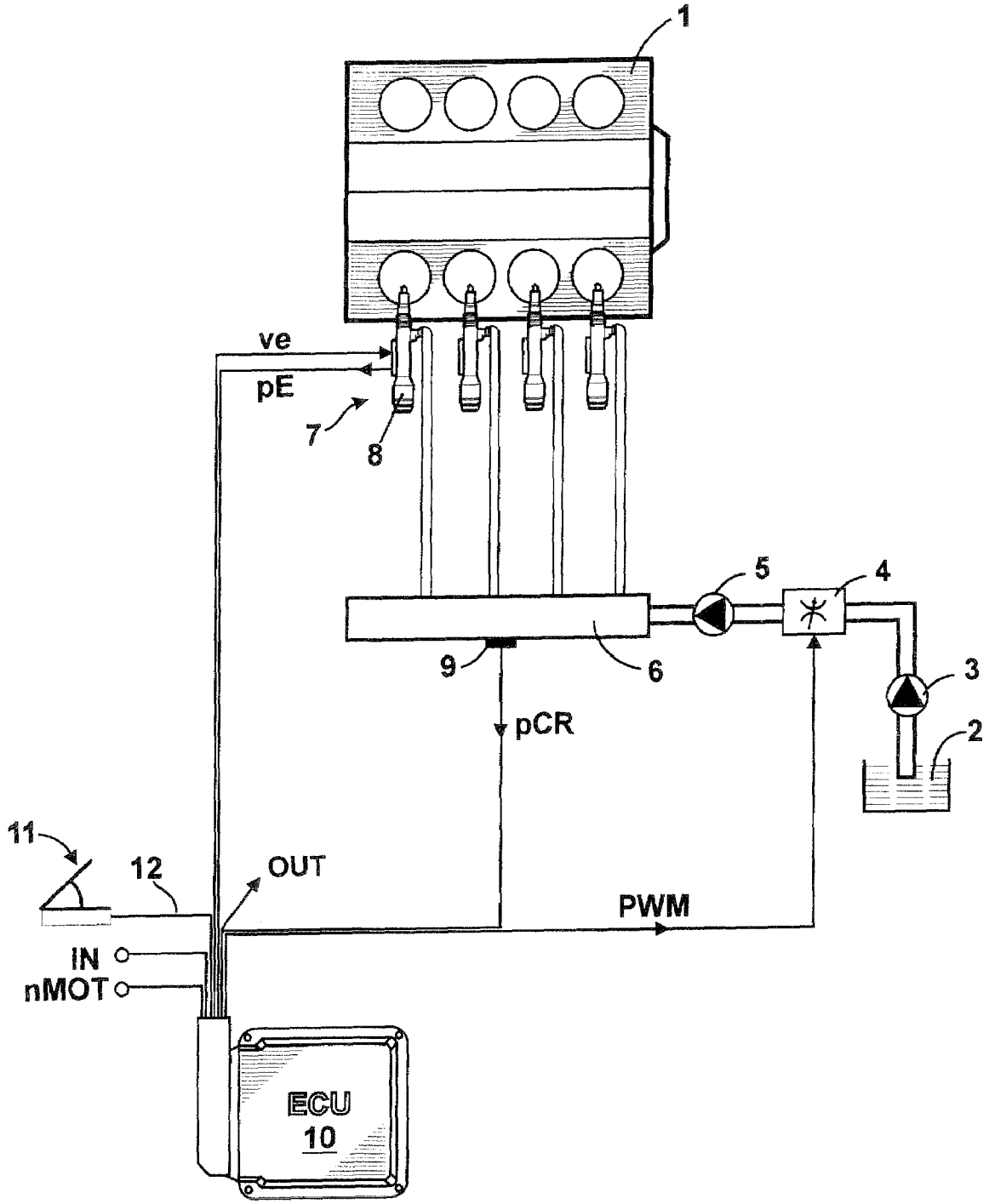
FIG. 1 shows a system diagram.

FIG. 1 shows a system diagram of an electronically controlled internal combustion engine 1. A common rail system with individual accumulators is shown as the injection system. As is well known, the common rail system comprises the following mechanical components: a low-pressure pump 3 for pumping fuel from a fuel tank 2, a suction throttle 4 for controlling the volume now of the fuel, a high-pressure pump 5 for pumping the fuel at increased pressure into a rail 6, and injectors 7 for injecting the fuel into the combustion chambers of the internal combustion engine 1. In the illustrated common rail system, an individual accumulator 8 is integrated in each injector 7. A common rail system with individual accumulators 8 differs from a conventional common rail system in that the energy needed for the injection is supplied by the individual accumulator by utilizing the volume elasticity of the fuel. The feed line from the rail 6 to the individual accumulator 8 is dimensioned in such a way that at the start of a new injection, the individual accumulator 8 is completely filled again.

The operating point of the internal combustion engine 1 is determined by an electronic engine control unit 10 (ECU) as a function of the input variables. The drawing shows the following as input variables: a rail pressure pCR, which is detected by a pressure sensor 9, an individual accumulator pressure pE, the engine speed nMOT, the position of the accelerator pedal 11, and a signal IN, which represents the other input signals, for example, the oil temperature. The drawing shows the following as output variables of the electronic engine control unit 10 for controlling the internal combustion engine 1: a signal PWM for adjusting the opening cross section of the suction throttle 4, a signal ve, which represents the start of injection and the end of injection, and a signal OUT, which comprises additional control signals, for example, a signal for switching on a second exhaust gas turbocharger. The accelerator pedal can be moved between an idle position LL and a full-load position VL. The mechanical position of the accelerator pedal 11 is detected by at least one potentiometer, and usually three. Their electrical signal values are read in by the electronic engine control unit 10 via a signal line 12 or several signal lines, for example, as an analog signal or by CAN bus.

Figure 2:
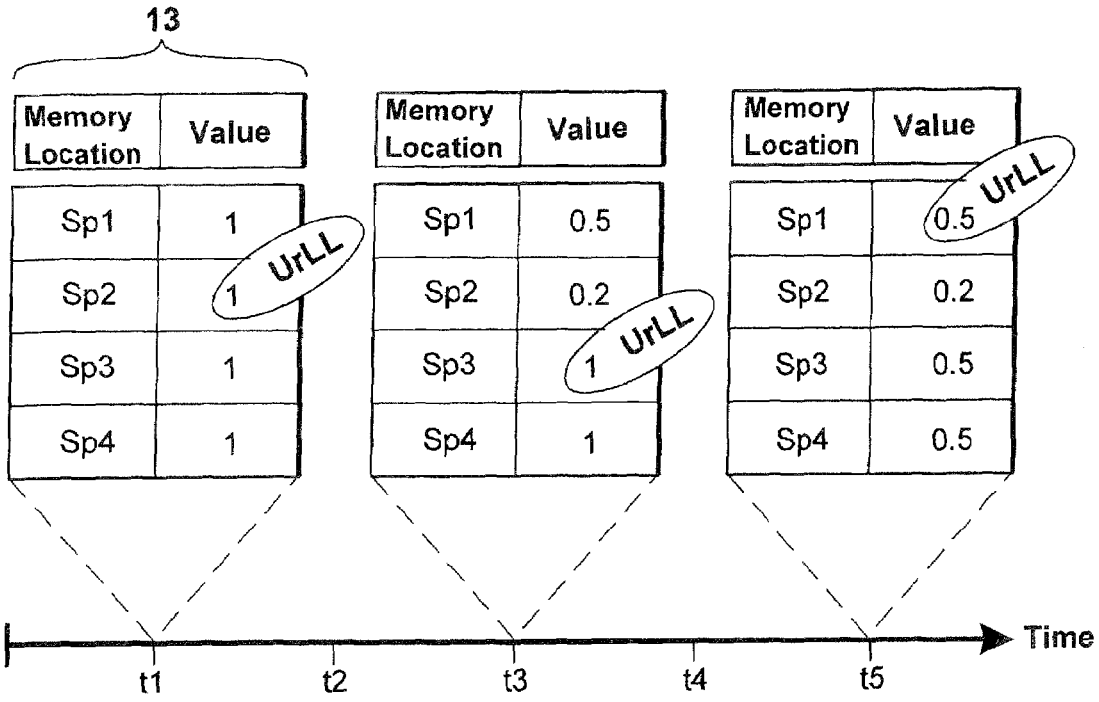
FIG. 2 shows the idle data memory over time.

FIG. 2 shows an idle data memory 13 over time with corresponding data values. This memory is typically realized as a toroidal-core memory, in which the data are cyclically overwritten. An idle data memory 13 and a full-load data memory 14 (FIG. 3) are assigned to each potentiometer connected with the accelerator pedal 11. The idle data memory 13 illustrated here contains four memory locations SP1 to SP4. However, the number of memory locations is not to be considered exclusive. After the initialization of the electronic engine control unit, at time t1 all of the memory locations of the idle data memory 13 are occupied by an idle limit LLGW of, for example, 1 V. The representative idle signal value UrLL is then determined by a minimum value selector. Therefore, at time t1 UrLL=1 V. The remainder of the method consists in comparing each detected idle signal value ULL with the idle limit LLGW. If the idle signal value ULL is less than or equal to the idle limit LLGW, then the idle signal value ULL is accepted in the idle data memory 13. Otherwise, the data value is discarded.

At time t2 an idle signal value of 0.5 V was detected and stored in the first memory location SP1. Since the values in the other memory locations SP2-SP4 are still occupied by the idle limit LLGW=1 V, the representative idle signal value is calculated to be UrLL=1 V. In the illustrated example, at time t3 an idle signal value of ULL=0.2 V is detected and stored in the second memory location SP2. The representative idle signal value remains unchanged at UrLL=1 V. In the remainder of the diagram, it was assumed that an idle signal value of ULL=0.5 V was measured at time t4 and an idle signal value of ULL=0.5 V was measured at time t5. These values were stored in the memory locations SP3 and SP4. The maximum value of the memory locations SP1 to SP4 is equal to 0.5 V at time t5. Therefore, the representative idle signal value at time t5 is UrLL=0.5 V. This potentiometer-specific idle signal value UrLL=0.5 V is set as the determining idle position LL of the accelerator pedal. In other words: if the electronic engine control unit detects a voltage level of 0.5 V, this is interpreted as an unactuated accelerator pedal.

Figure 3:
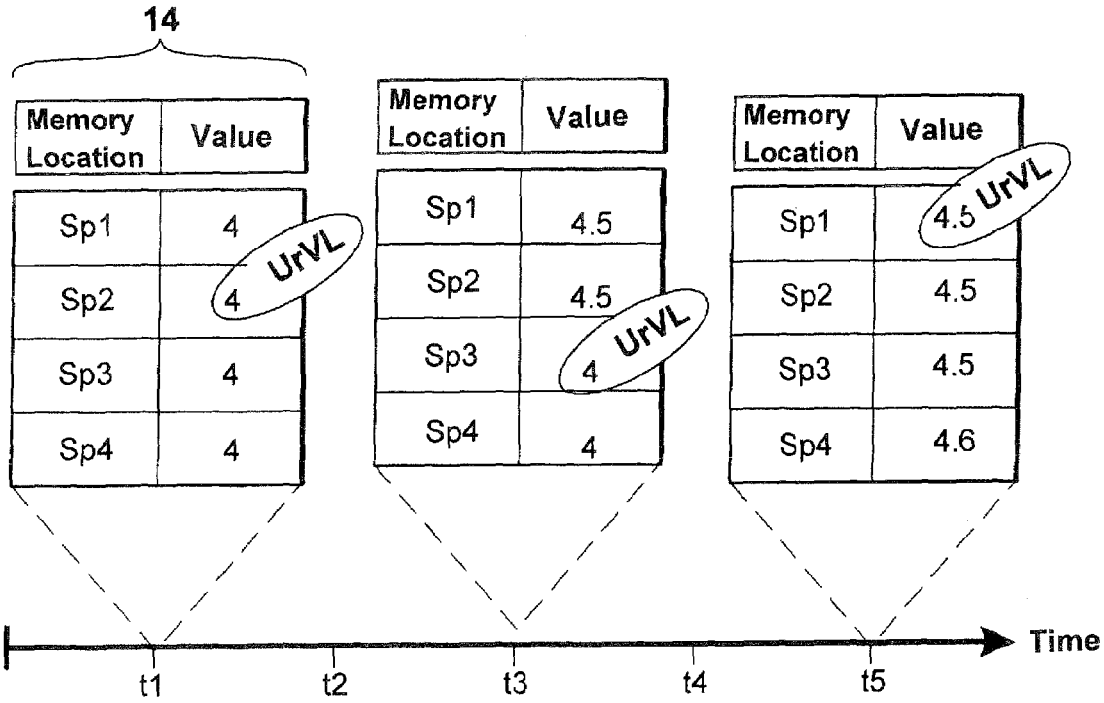
FIG. 3 shows the full-load data memory over time.

FIG. 3 shows the full-load data memory 14 over time with corresponding data values. This memory is likewise realized as a toroidal-core memory, ill which the data are cyclically overwritten. An idle data memory 13 and a full-load data memory 14 are assigned to each potentiometer connected with the accelerator pedal 11. The full-load data memory 14 illustrated here contains four memory locations SP1 to SP4. However, the number of memory locations is not to be considered exclusive. After the initialization of the electronic engine control unit, at time t1 all of the memory locations of the full-load data memory 14 are occupied by a full-load limit VLGW of, for example, 4 V. The representative full-load signal value UrVL is then determined by a minimum value selector. Therefore, at time t1 the representative full-load signal value UrVL=4 V. The remainder of the method consists in comparing each detected full-load signal value UVL with the full-load limit VLGW. If the full-load signal value UVL is greater than or equal to the full-load limit VLGW, then the full-load signal value UVL is accepted in the full-load data memory 14. Otherwise, the data value is discarded.

At time t2 a full-load signal value of 4.5 V was detected and stored in the first memory location SP1. Since the values in the other memory locations SP2-SP4 are still occupied by the full-load limit VLGW=4 V, the representative full-load signal value is calculated to be UrVL=4 V. In the illustrated example, at time t3 a full-load signal value of UVL=4.5 V is detected and stored in the second memory location SP2. The representative full-load signal value remains unchanged at UrVL=4 V at time t3. In the remainder of the diagram, it was assumed that a full-load signal value of 4.5 V was detected at time t4 and stored in the third memory location SP3. At time t5 a full-load signal value of UVL=4.6 V was detected and stored in the fourth memory location SP4. Therefore, the representative full-load signal value at time t5 is UrVL=4.5 V. This potentiometer-specific full-load signal value UrVL=4.5 V is set as the determining full-load position VL of the accelerator pedal. In other words: if the electronic engine control unit detects a voltage level of 4.5 V, this is interpreted as a completely actuated accelerator pedal.

Figure 4:
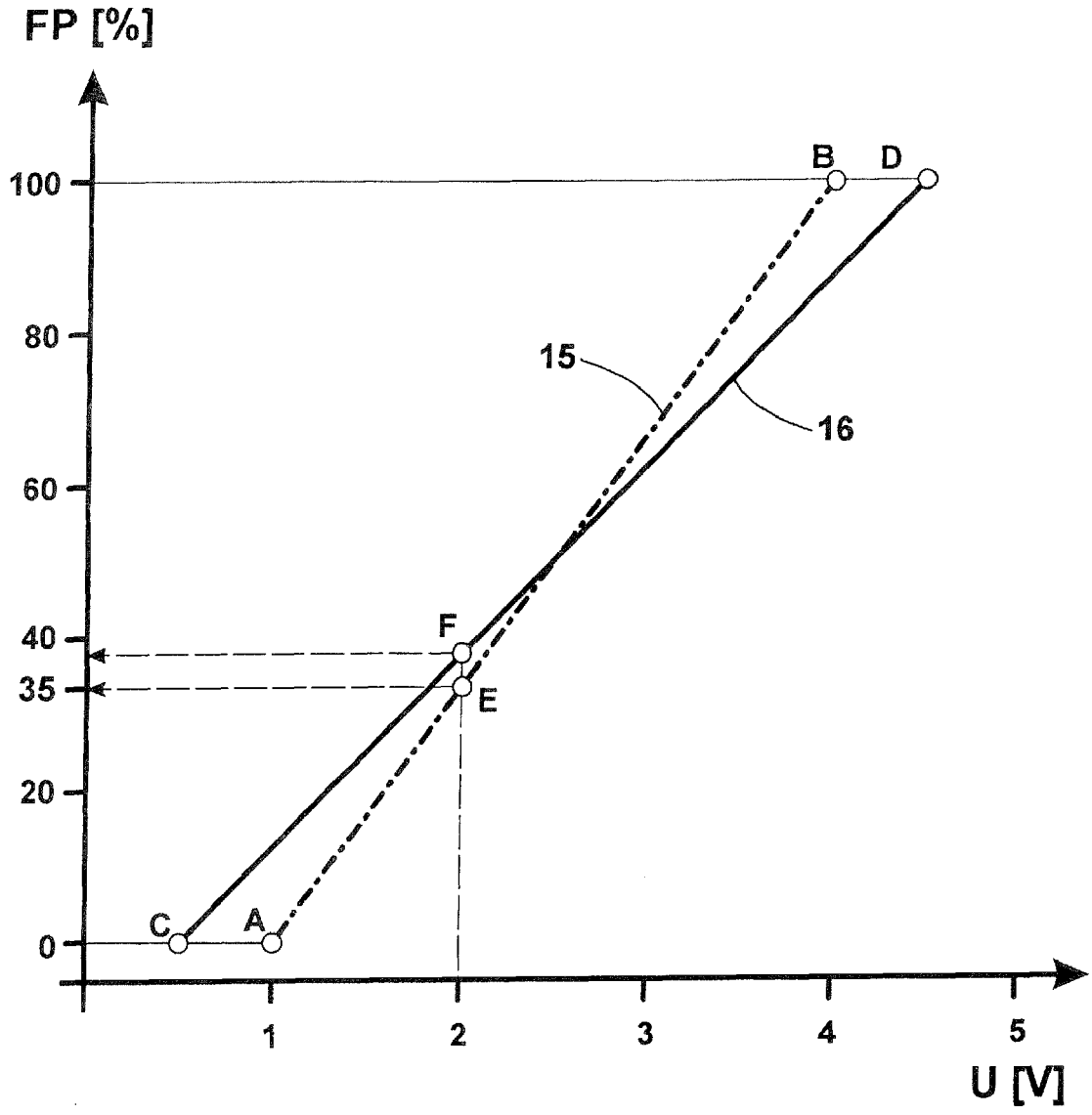
FIG. 4 shows a voltage accelerator pedal diagram of a potentiometer.

FIG. 4 shows a diagram of a signal voltage measured at a potentiometer. The detected signal voltage U is plotted on the x-axis, and the associated accelerator pedal position in percent is plotted on the y-axis. For the sake of better clarity, the zero point of the y-axis is shifted from the origin in the direction of positive accelerator pedal values. The zero percent accelerator pedal position (FP=0%) corresponds to an unactuated accelerator pedal, i.e., to the idle position LL. The hundred percent accelerator pedal position (FP=100%) corresponds to a fully actuated accelerator pedal, i.e., to the full-load position VL. The data values of FIGS. 2 and 3 correspond to this diagram.

In the initial state, i.e., at time t1 in FIGS. 2 and 3, the representative idle signal value UrLL=1 V. This corresponds to point A. The representative full-load signal value is UrVL=4 V. This corresponds to point B. Points A and B define a positive straight line 15, which is plotted as a dot-dash line in FIG. 4. If a signal value of, for example, 2 V is now detected, then it is assigned an accelerator pedal value of about 35% via the working point E on the straight line 15. At time t5 the representative idle signal value UrLL=0.5 V. This corresponds to point C. The representative full-load signal value is URVL=4.5 V. This corresponds to point D. Points C and D define a positive straight line 16. As shown in the diagram, the representative idle signal value UrLL was adapted to smaller signal values by learning, while the representative full-load signal value UrVL was adapted to larger signal values by learning. If a signal value of 2 V is now detected, then it is assigned an accelerator pedal value of about 39% via the working point F on the straight line 16. The potentiometer in question was thus calibrated to the idle position LL and the full-load position VL.

Figure 5:
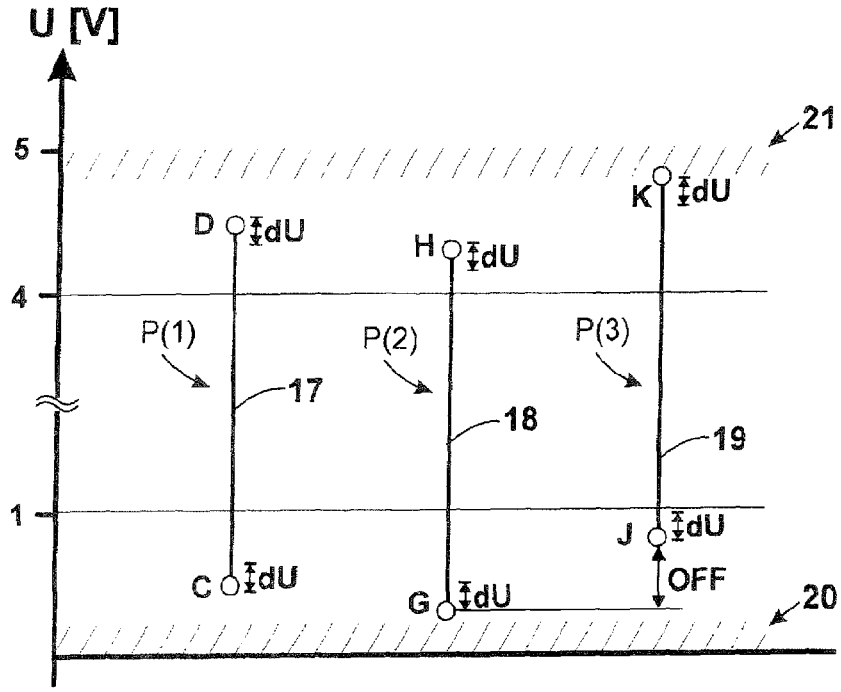
FIG. 5 shows a diagram of the potentiometer swing.
Figure 6:
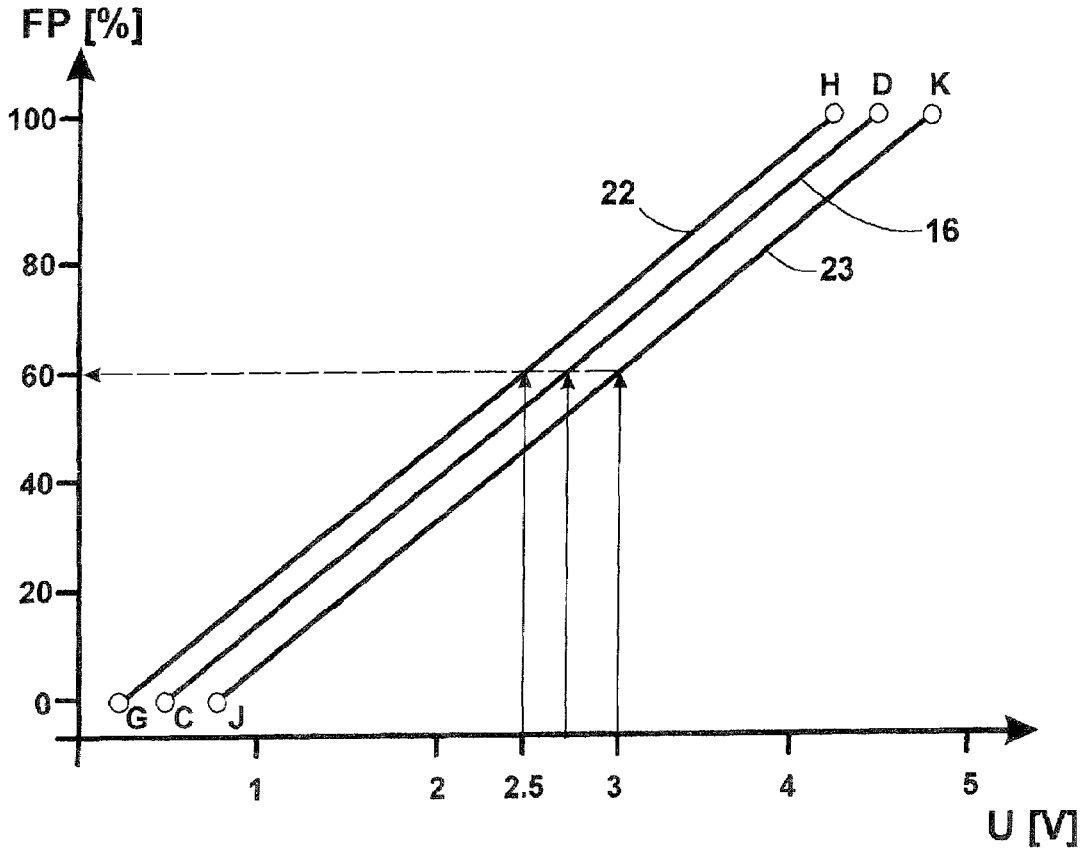
FIG. 6 shows a diagram for three potentiometers.

FIG. 5 shows a diagram of the potentiometer swing of three potentiometers that were used. The diagram is based on potentiometers with a uniform potentiometer swing of 4 V. Both an idle data memory and a full-load data memory are assigned to each potentiometer. The potentiometer-specific representative idle and full-load signal values are determined separately for each potentiometer by the method described in connection with FIGS. 2 and 3. The signal graphs in FIG. 6, which shows the accelerator pedal position FP versus the measured signal voltage U, are associated with the potentiometer swings shown in FIG. 5. FIGS. 5 and 6 will now be explained in greater detail together.

The signal voltage U in volts is plotted on the y-axis in FIG. 5. A representative idle signal value UrLL=0.5 V, point C, is obtained for a first potentiometer P(1). The associated full-load signal value is UrVL=4.5 V, point D. The potentiometer swing 17 of the first potentiometer P(1) is thus equal to the interval CD. The computed idle and full-load signal values thus correspond to the potentiometer described in connection with FIGS. 2 and 3. A representative idle signal value UrLL=0.3 V, point G, is obtained for a second potentiometer P(2). The associated full-load signal value is UrVL=4.3 V, point H. Therefore, the potentiometer swing 18 of the second potentiometer P(2) is equal to the interval GH. A representative idle signal value UrLL=0.8 V, point J, is obtained for a third potentiometer P(3). The associated full-load signal value is UrVL=4.8 V, point K. The potentiometer swing 19 of the third potentiometer P(3) corresponds to the interval JK. A minimum error range 20 and a maximum error range 21, each with a bandwidth of, for example, 0.2 V, are shown as shaded areas. Values that lie within the range are discarded. The illustrated potentiometers all fall within the permissible range. To improve the operating reliability, it can additionally be provided that the given representative idle and full-load signal value is changed by a safety offset dU, for example, 0.05 V. An accelerator pedal position FP of 60% is assigned via the straight line 16 to a detected signal voltage of 2.8 V at the first potentiometer P(1), as shown in FIG. 6. An accelerator pedal position FP of 60% is likewise assigned via the straight line 22 to a signal voltage of 2.5 V at the second potentiometer P(2). An accelerator pedal position FP of 60% is also assigned via the straight line 23 to a signal voltage of 3 V at the third potentiometer P(3). Accordingly, FIG. 6 clearly shows that different signal values of the three potentiometers are assigned the same accelerator pedal position.

FIG. 5 shows an offset OFF of the point J from the point G. The offset will be explained in connection with the description of the reference potentiometer in FIG. 10.

Figure 7:
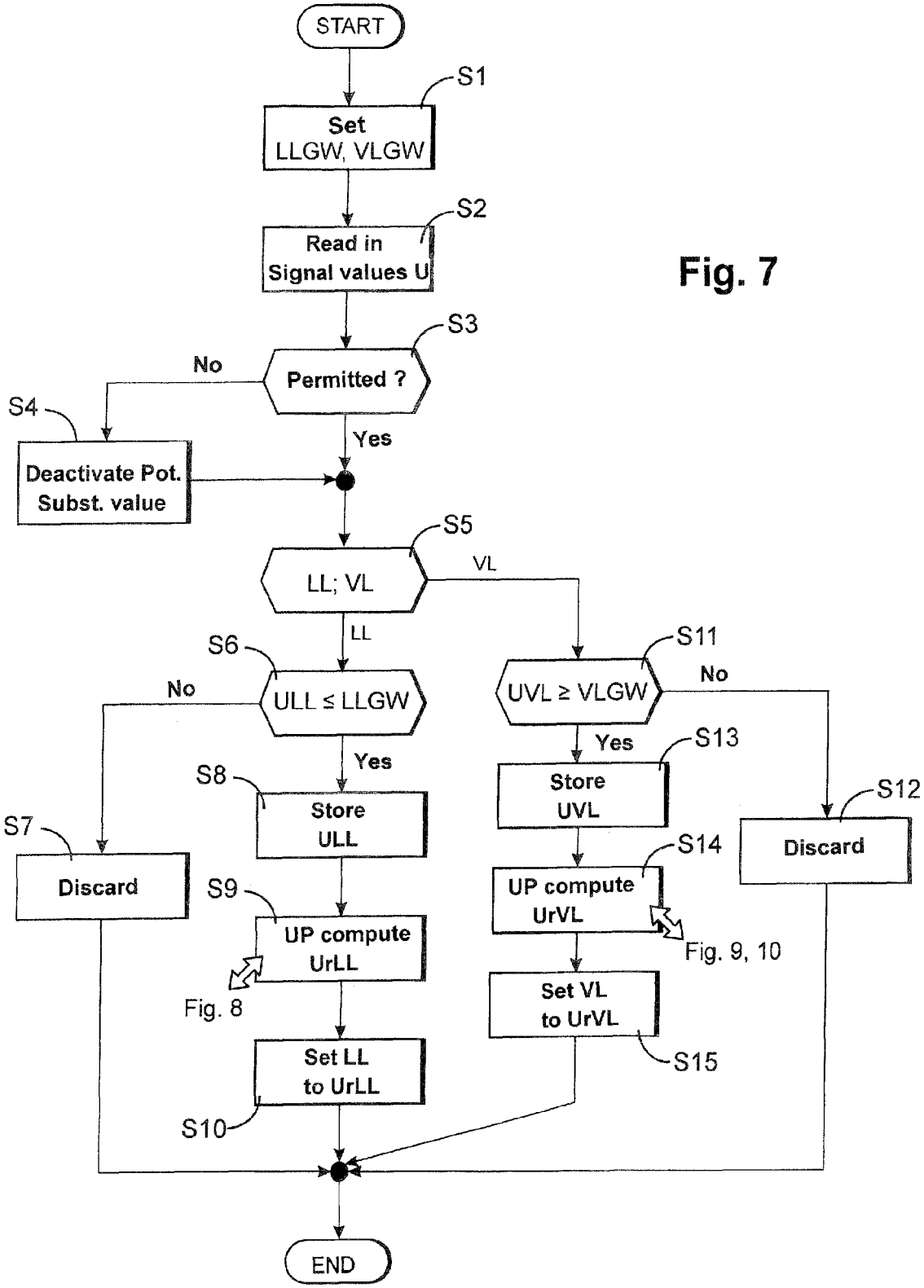
FIG. 7 shows a program flowchart.

FIG. 7 shows a program flowchart for a main program. At S1 the idle limit LLGW and the full-load limit VLGW are set for the one or more potentiometers. When three potentiometers are used on an accelerator pedal, this means that there are two limits for each. At S2 the signal values are then read in, and at S3 they are tested for permissibility. A signal value is impermissible if it lies in the minimum or maximum error range (FIG. 5: 20, 21). If the signal values are not permissible (interrogation result S3: no), then at S4 the potentiometer in question is deactivated, a substitute value is set for this potentiometer, and the program flows to S5. If the detected signal values are permissible (interrogation result S3: yes), then the program flow branches at S5. If idling LL is being considered, the routine S6 to S10 is carried out, while if full load VL is being considered, the routine S11 to S15 is carried out.

Figure 8:
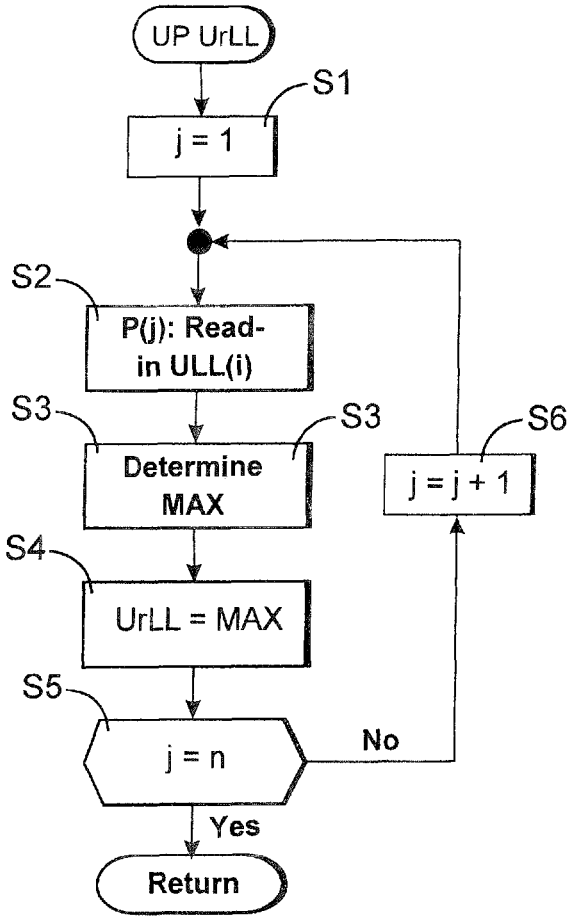
FIG. 8 shows one version of a subroutine for computing UrLL.

At S6 a check is made to determine whether the current idle signal value ULL is less than or equal to the idle limit LLGW. If this is not the case (interrogation result S6: no), then at S7 the detected idle signal value ULL is discarded, and the program ends. At an idle signal value ULL that is less than or equal to the idle limit LLGW (interrogation result S6: yes), the idle signal value is stored in the idle data memory at S8. The program then branches off to a subroutine (UP) at S9 to compute the representative signal value UrLL. This subroutine is shown in FIG. 8 and will be explained later in connection with FIG. 8. After the computation of the representative idle signal value UrLL, at S10 the idle position LL, i.e., an accelerator pedal position FP of 0%, is assigned to the representative idle signal value UrLL, and the program ends.

Figure 9:
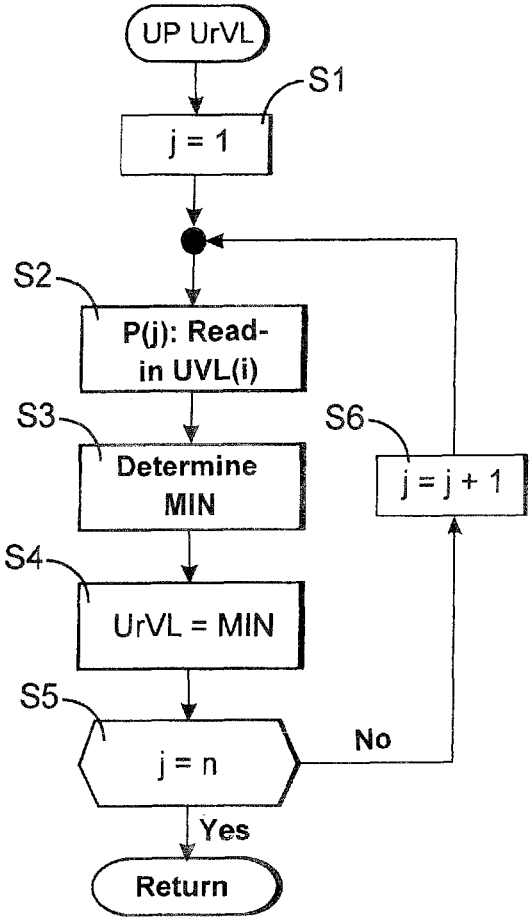
FIG. 9 shows a first version of a subroutine for computing UrVL
Figure 10:
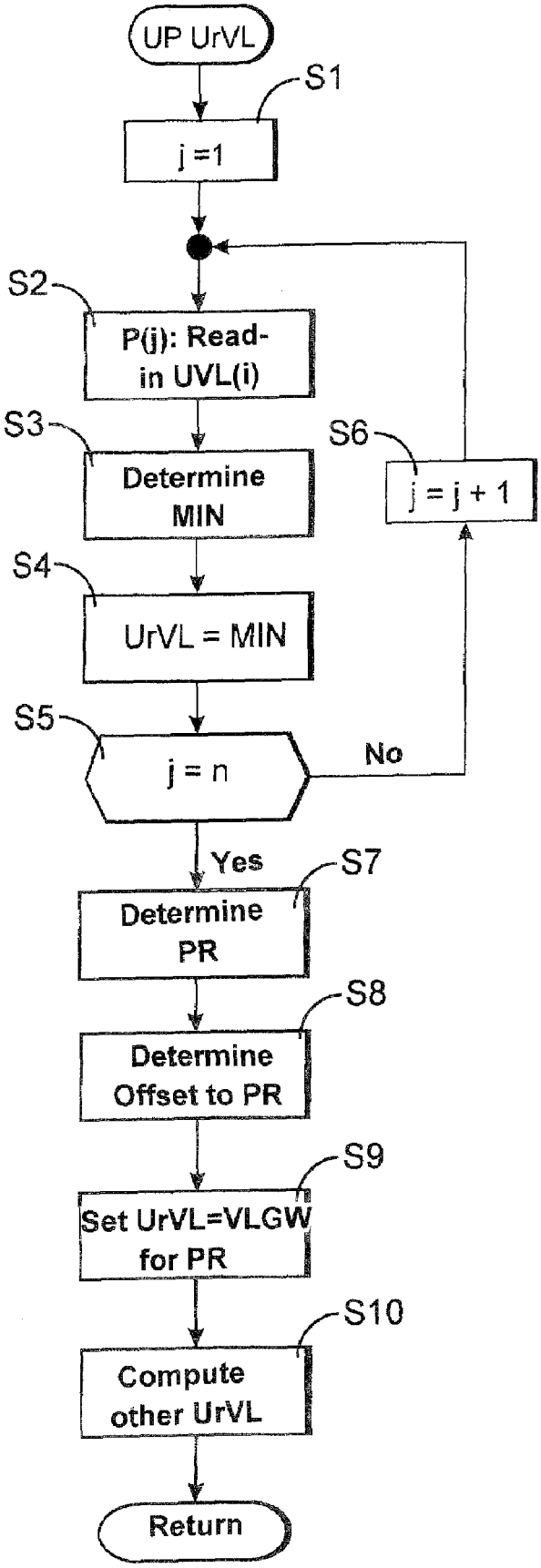
FIG. 10 shows a second version of a subroutine for computing UrVL.

If full load is to be considered, then at S5 the program flow branches off to S11. At S11 a check is performed to determine whether the detected full-load signal value UVL is greater than or equal to the full-load limit VLGW. If this is not the case (interrogation result S11: no), then at S12 the detected full-load signal value UVL is discarded, and the program ends. If the full-load signal value UVL is greater than or equal to the full-load limit VLGW (interrogation result S11: yes), then at S13 the full-load signal value UVL is stored in the full-load data memory, and the program branches off to a subroutine (UP) at S14 for computing the representative full-load signal value UrVL. FIGS. 9 and 10 show different versions of the subroutine, and these different versions will be explained in connection with these figures. After the representative full-load signal value UrVL has also been computed, the full-load position VL, i.e., an accelerator pedal position of 100%, is assigned at S15 to the representative full-load signal value UrVL. The main program then ends.

FIG. 8 shows one version of a subroutine (UP) for computing the representative idle signal value UrLL. At S1 a running variable j is set to the value 1. The running variable j designates the potentiometer P(j) under consideration. The terminal value n designates the number of potentiometers connected to the accelerator pedal. For example, if three potentiometers are connected, then n=3. At S2 the idle signal values ULL(i) of the potentiometer under consideration, which are stored in the idle data memory, are read in. The running variable i designates the memory location. If four memory locations are being used, as illustrated in FIG. 2, then the variable i runs through the range of values 1 to 4. At S3 the maximum value MAX of the idle signal values ULL(i) is determined, and at S4 the potentiometer-specific representative idle signal value UrLL is set to the value MAX. At S5 a test is performed to determine whether the representative idle signal value UrLL has been calculated for all connected potentiometers. If only one potentiometer is to be checked, then the terminal value n=1 has been reached, and the program branches back to the main program of FIG. 7. If the terminal value ii has not yet been reached (interrogation result S5: no), then at S6 the running variable j is increased by 1, and the program flow returns to S2. If, for example, three potentiometers are used, then a potentiometer-specific representative idle signal value is determined for each potentiometer by means of the idle data memory assigned to it. For the examples illustrated in FIGS. 5 and 6, these values are UrLL=0.5 V for the first potentiometer P(1), UrLL=0.3 V for the second potentiometer P(2), and UrLL=0.8 V for the third potentiometer P(3). The program then branches back to the main program of FIG. 7.

FIG. 9 shows a first version of a subroutine for computing the representative full-load signal value UrVL. At S1 a running variable j is set to the value 1. The running variable j designates the potentiometer P(j) under consideration. The terminal value n designates the number of potentiometers connected to the accelerator pedal. For example, if three potentiometers are connected, then n=3. At S2 the full-load signal values UVL(i) of the potentiometer under consideration, which are stored in the full-load data memory, are read in. The running variable i designates the memory location. If four memory locations are being used, as illustrated in FIG. 2, then the variable i runs through the range of values 1 to 4. At S3 the minimum value MIN of the full-load signal values UVL(i) is determined, and at S4 the potentiometer-specific representative full-load signal value UrVL is set to the value MIN. At S5 a test is performed to determine whether the representative full-load signal value UrVL has been calculated for all connected potentiometers. If only one potentiometer is to be checked, then the terminal value n=1 has been reached, and the program branches back to the main program of FIG. 7. If the terminal value n has not yet been reached (interrogation result S5: no), then at S6 the running variable j is increased by 1, and the program flow returns to S2. If, for example, three potentiometers are used, then a potentiometer-specific representative full-load signal value is determined for each potentiometer by means of the full-load data memory assigned to it. For the examples illustrated in FIGS. 5 and 6, these values are UrVL=4.5 V for the first potentiometer P(1), UrVL=4.3 V for the second potentiometer P(2), and UrVL=4.8 V for the third potentiometer P(3). The program then branches back to the main program of FIG. 7.

In a modification (not shown) of the program sequences of FIGS. 8 and 9, it can be provided that a safety offset dU, for example, 0.05 V, is subtracted from the potentiometer-specific representative idle and full-load signal value (see FIG. 5).

FIG. 10 shows a second version of a subroutine for computing the representative full-load signal value UrVL. The subroutine with the program steps S1 to S6 is identical to that of FIG. 9. If it is determined at S5 that all of the potentiometers were considered (interrogation result S5: yes), then a reference potentiometer PR is determined at S7. The potentiometer whose representative idle signal value UrLL is minimal is set as the reference potentiometer PR. For the examples illustrated in FIGS. 5 and 6, this is the second potentiometer P(2) with a representative idle signal value UrLL=0.3 V.

At S8 an offset is determined by taking the difference of the potentiometer under consideration and the representative idle signal value UrLL of the reference potentiometer PR. The offset of the first potentiometer P(1) from the reference potentiometer (P(2) in this case) is OFF=0.2 V. The offset OFF of the third potentiometer P(3) from the second potentiometer P(2) is OFF=0.5 V. At S9 the representative full-load signal value UrVL of the reference potentiometer PR is then set to the value of the full-load limit VLGW; in numerical values, UrVL=4 V for the second potentiometer P(2). At S10 the respective representative full-load signal values UrVL are determined for the other potentiometers by adding the respective offset to the full-load limit VLGW, i.e., 4 V. Therefore, the value UrVL=4.2 V is obtained for the first potentiometer P(1), and the value UrVL=4.5 V is obtained for the third potentiometer P(3). The program then branches back to the main program of FIG. 7.

In a modification (not shown) of FIG. 10, it is provided that the method of FIG. 10 is started only when a representative idle signal value UrLL of the connected potentiometers becomes less than the idle limit.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A method for calibrating an accelerator pedal during driving operation, comprising the steps of:

converting a mechanical position of the accelerator pedal to an electrical signal value by at least one potentiometer and reading the signal value to an electronic engine control unit;

setting an idle limit for an idle position of the accelerator pedal and a full-load limit for a full-load position of the accelerator pedal as initial values;

storing an idle signal value that is less than or equal to the idle limit in a potentiometer-specific idle data memory for each potentiometer;

determining a representative idle signal value from at least one stored idle signal values value;

setting the determined representative idle signal value as the determining idle position of the accelerator pedal specific to each potentiometer;

storing a full-load signal value that is greater than or equal to the full-load limit in a potentiometer-specific full-load data memory for each potentiometer;

determining a representative full-load signal value from at least one stored full-load signal value setting the determined representative full-load signal value as the determining full-load position of the accelerator pedal specific to each potentiometer, wherein the converting step includes converting by at least two potentiometers; and determining a reference potentiometer from the potentiometers, computing an offset of the representative idle signal value of the potentiometers to the representative idle signal value of the reference potentiometer, setting the representative full-load signal value for the reference potentiometer to the full-load limit, computing the representative full-load signal value of the potentiometers by adding the offset to the full-load limit, and setting this computed value as the determining full-load position of the accelerator pedal.

2. The method in accordance with claim 1, wherein the representative idle signal value corresponds to a maximum value of the at least one stored idle signal value, and the representative full-load signal value corresponds to a minimum value of the at least one stored full-load signal value.

3. The method in accordance with claim 1, wherein the potentiometer that is set as the reference potentiometer is the potentiometer whose representative idle signal value is minimal.

4. The method in accordance with claim 3, including initiating an iterative portion of the method when a representative idle signal value of the connected potentiometers becomes less than the idle limit.

5. The method in accordance with claim 1, wherein the representative full-load signal value is limited.

6. The method in accordance with claim 1, including increasing or decreasing the representative idle signal value and the representative full-load signal value by a predeterminable safety offset.

* * * * *